US007311178B2

(12) United States Patent
Blackwell

(10) Patent No.: US 7,311,178 B2
(45) Date of Patent: Dec. 25, 2007

(54) WORK PIECE SUPPORT HINGE ASSEMBLY

(76) Inventor: James P. Blackwell, 5052 Hollister Ave., Santa Barbara, CA (US) 93110

( * ) Notice: Subject to any disclaimer, the term of this patent is extended or adjusted under 35 U.S.C. 154(b) by 104 days.

(21) Appl. No.: 09/949,944

(22) Filed: Sep. 10, 2001

(65) Prior Publication Data

US 2003/0047384 A1 Mar. 13, 2003

(51) Int. Cl.
*E04G 1/00* (2006.01)

(52) U.S. Cl. ..... 182/186.5; 182/186.4

(58) Field of Classification Search ..... 182/186.5, 182/186.4, 151, 181.1, 153, 185.1
See application file for complete search history.

(56) References Cited

U.S. PATENT DOCUMENTS

| | | | | | |
|---|---|---|---|---|---|
| 2,602,008 | A | * | 7/1952 | HasselBring | 182/151 |
| 2,990,909 | A | * | 7/1961 | Alkens | 182/186.3 |
| 3,110,360 | A | | 11/1963 | Hearn | 182/155 |
| 3,139,950 | A | | 7/1964 | Bormann | 182/184 |
| 3,445,129 | A | * | 5/1969 | Penote | 403/174 |
| 3,704,849 | A | * | 12/1972 | Green | 182/151 |
| 4,102,434 | A | * | 7/1978 | Blank | 182/186.4 |
| 4,565,263 | A | | 1/1986 | Southworth | 182/184 |
| 4,756,384 | A | | 7/1988 | Maddox | 182/18 |
| 4,804,064 | A | | 2/1989 | Coultrup et al. | 182/155 |
| 4,890,693 | A | | 1/1990 | O'Brien | 182/151 |
| 4,903,796 | A | * | 2/1990 | Magyar et al. | 182/129 |
| 5,207,290 | A | | 5/1993 | Torok | 182/153 |
| 5,377,779 | A | * | 1/1995 | Slapnicka | 182/153 |
| 5,484,037 | A | | 1/1996 | Neumarkel | 182/185 |
| 5,560,449 | A | * | 10/1996 | Smith | 182/153 |
| 5,647,455 | A | | 7/1997 | Russell | 182/153 |
| 5,779,003 | A | | 7/1998 | Carty | 182/225 |
| 5,813,495 | A | | 9/1998 | Smith | 182/155 |
| 6,092,627 | A | * | 7/2000 | Burger | 182/153 |
| 6,129,180 | A | * | 10/2000 | Brady | 182/186.4 |
| 6,161,808 | A | | 12/2000 | East et al. | 248/175 |
| 6,209,683 | B1 | | 4/2001 | Holtz | 182/225 |

* cited by examiner

*Primary Examiner*—Alvin Chin-Shue
(74) *Attorney, Agent, or Firm*—Howrey LLP

(57) ABSTRACT

A work piece support assembly can be assembled in either an operating configuration or in a flattened coplanar configuration for storage. The support assembly includes a pair of leg assemblies, one each for the proximal and distal end portions of an elongated rail support member. Each end of the rail support member has a portion having two leg socket assemblies. Each socket assembly has a first and second socket with respective first and second centerlines that may be non parallel and intersect at a predetermined point. Each leg assembly has a stem assembly comprised of a first and second stem portion, which are both pivotally coupled to the rail support member through the first and second sockets of each socket assembly. In its operational configuration, the first and second leg of each leg assembly is transverse to the rail support member. In the flattened storage configuration, the leg assemblies counter rotate resulting in each leg assembly being coplanar to the rail support member.

12 Claims, 7 Drawing Sheets

WORK PIECE SUPPORT HINGE ASSEMBLY

BACKGROUND OF THE INVENTION

1. Field of the Invention

The present invention relates to work piece support assemblies and, in particular, to a support that pivots the leg assembly thereby allowing efficient assembly and storage. The invention further relates to a method for providing a pivoting hinge, and to a kit having the components for assembling the work piece support assembly.

2. Background

Many various designs of work piece support assemblies are well known in the art. The basic carpenters support assembly has been made of wood with legs nailed or otherwise secured to a horizontal beam. Such a support assembly is typically fixedly assembled and must be stored and moved in its completed form. Storing and transporting such a support assembly is space consuming and does not lend itself to efficient storage.

Typically, pieces of lumber are often secured together to form a work piece support assembly using hardware components that are commercially available. This may result in a support assembly of considerable weight that is either permanently or reversibly assembled. However, once the support assembly is disassembled there is usually no convenient way to keep all the various parts and components together for reassembly.

This has resulted in various efforts to design work piece support assemblies make construction, transportation and storage more efficient and convenient. These include designs that provide for either the folding and/or telescoping of the legs relative to the elongated rail support member. It is also known to provide attachment pieces together so that the support assembly may be dismantled, with the resulting pieces less likely to become lost. Typically, such designs are expensive in that special manufactured parts are required. Some designs can accommodate replacing the elongated rail support member, upon extraordinary wear or damage. Some designs use the elongated rail itself as part of the support structure. An example of this is found in U.S. Pat. No. 5,779,003 issued Jul. 14, 1998 to W. F. Carty, where each end of a horizontal rail is used to attach brackets for supporting legs of a collapsible sawhorse. The only horizontal structure is the rail itself. In U.S. Pat. No. 5,647,455 issued Jul. 15, 1997 to D. L. Russell, the opposite approach is used, where the tubular outer and inner hinge members provide the horizontal support between each leg assembly, and an engaging member (rail) is attached to the top side of the outer hinge member.

Work piece support assemblies typically serve a single function, that of providing an elevated elongated rail, for use by carpenters, framers, those in other construction trades, as well as homeowners, gardeners and hobbyists. Some designs have been developed that have built-in tool shelves, and some also provide steps for use of the unit as a step ladder. These support assemblies or substantially similar designs can also be the basis for other structures such as scaffolding, work or support platforms, sawhorses and tables.

Therefore, what is needed is a work piece support assembly that can alternate between an operational configuration and an efficient transportation and storage configuration. The efficiency in storage relates to the ease and convenience of storing, the space occupied during storage, and in the retention of component parts. There also is a need for a support assembly that is inexpensive to make, and which can be easily assembled or positioned between operational and storage modes without special tools, to form a stable and lightweight structure.

SUMMARY OF THE INVENTION

The present invention relates to a device, apparatus, kit and method for a leg hinge and work piece support assembly. The present invention allows for efficient storage and operational use of a work piece support assembly by providing a means to pivot both leg assemblies until they are substantially coplanar and substantially lying flat with the elongated rail member of the support assembly.

In accordance with one aspect of the present invention, a hinge device is provided for pivoting a leg assembly of a work piece support assembly into an operational or storage position, whereby the hinge device is a leg assembly having a leg portion and a stem assembly defined by two adjacent stem portions that allow insertion and connection of the stem assembly into a leg socket assembly comprised of two adjacent sockets, either socket having a centerline that is non parallel to the other socket centerline, and which converges and intersects at a predetermined point, whereby upon insertion of the two stem portions into the leg socket assembly, the leg portion comprised of two legs interconnected by a brace member, can be rotated and positioned substantially transversely with respect to the work piece support assembly.

In accordance with an additional aspect of the present invention, a work piece support assembly apparatus is provided which includes an elongated rail support member having a leg socket assembly at the proximal and distal ends of the rail member, a proximal leg assembly and a distal leg assembly each defined as having a first and second leg disposed in angular opposition to each other, and interconnected by a brace member, thereby forming each leg assembly as having a stem assembly comprised of a first and second stem portion opposite the brace member, each stem portion angled and pivotally coupled to the socket assembly, having a first and second socket with respective centerlines that are non parallel and that converge to intersect at a predetermined point.

A further aspect of the invention includes a kit for providing a work piece support assembly from the provided components, this kit including a rail support member with opposing ends each having a leg socket assembly defined by two adjacent sockets, two leg assemblies each comprised of a leg portion and a stem assembly, each leg portion comprised of two legs interconnected by a brace member, each stem assembly including two stem portions for insertion into the leg socket assembly and rotation such that the leg portion of the leg assembly is positioned transversely relative to the rail support member.

A still further aspect of the invention includes a method for providing a hinge for pivoting a leg assembly coupled to a leg socket assembly into an operational or storage position.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

The leg hinge and work piece support assembly of the present invention relates to a device, apparatus, kit and method thereof for pivoting a leg assembly. The work piece support assembly of the present invention allows for an operational and storage configurations of the work piece support assembly and leg hinge by providing a transversely rotatable leg assembly disposed at the proximal and distal ends of the rail support assembly. The leg assemblies support and elevate the rail support assembly to a customary and usual height, which can be varied according to the length and spacing between the legs. The invention is described herein as a sawhorse as being used for the construction trades, particularly those in carpentry or framing. However, the invention may be used by homeowners, hobbyists or by anyone as a work or support platform. Alternative embodiments could easily be used to support and elevate beams, platforms, scaffolding, tables and other support beams or surfaces.

Figure 1A:
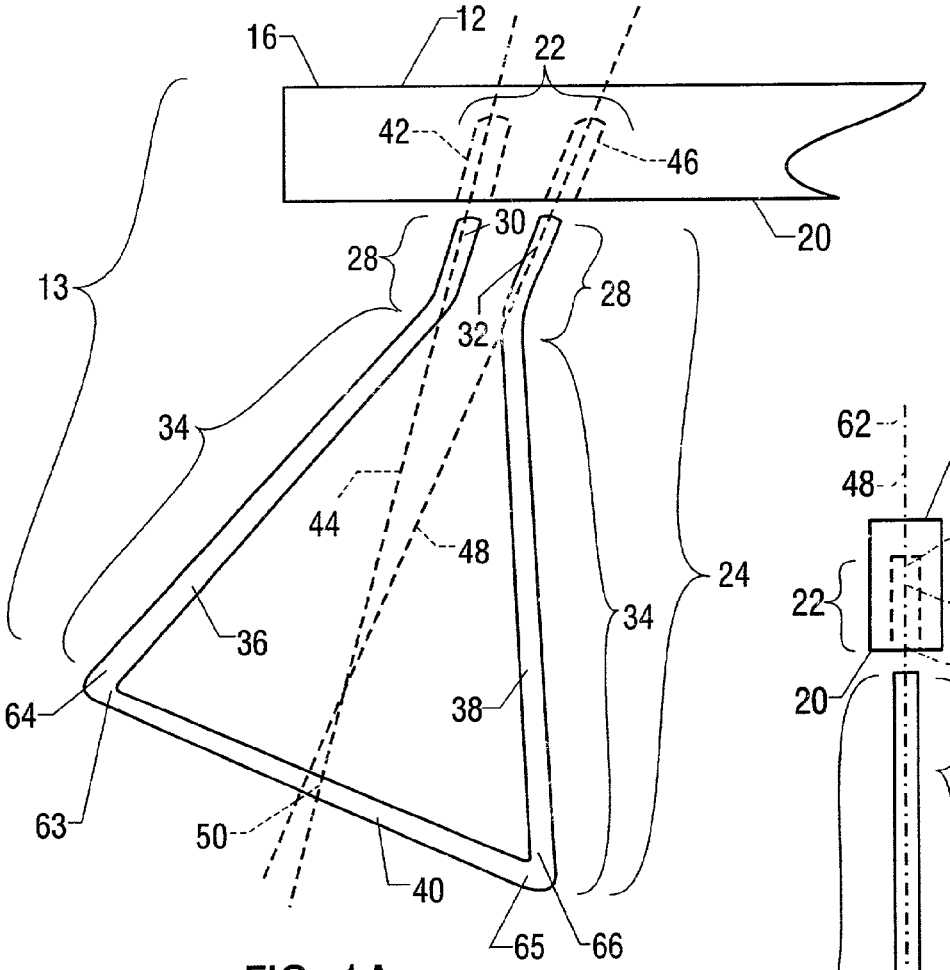
FIG. 1A is a partial exploded side view illustrating the leg hinge device, according to the present invention.
Figure 1B:
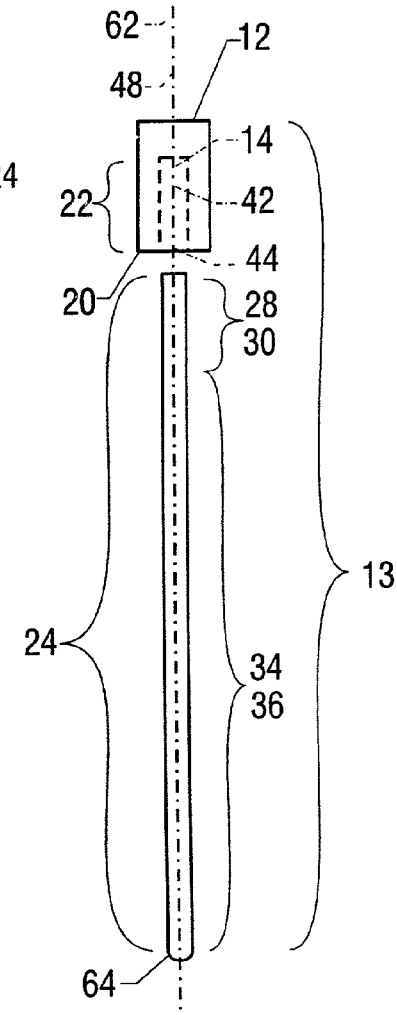
FIG. 1B is an end view illustrating the leg hinge device depicted in FIG. 1A, according to the present invention.
Figure 3:
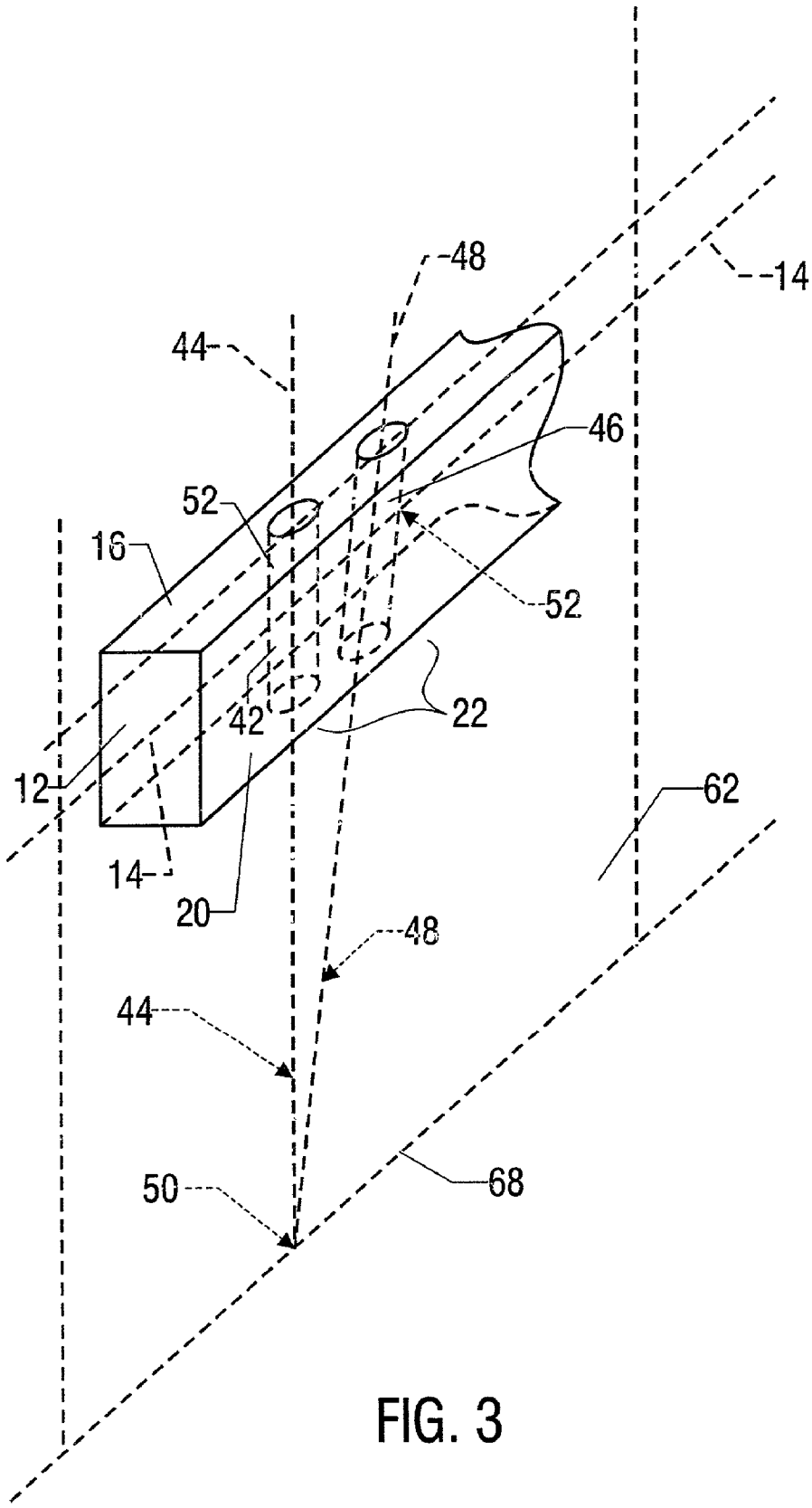
FIG. 3 is a phantom perspective view of a leg socket assembly at the proximal end of an elongated rail support member, according to the present invention.

Referring now to the drawings, depicted therein as the side and end views from FIGS. 1A and 1B, is one embodiment of a leg hinge device 13 shown partially assembled. A leg hinge 13 is located at the proximal end 16 of an elongated rail support member 12. Here, the leg hinge 13 comprises a leg socket assembly 22 and proximal leg assembly 24. The leg socket assembly 22 is preferably located on the underside surface portion 20 of the rail support member 12, but may alternatively be located on lateral rail extensions (not shown) fixedly attached to the vertical side surfaces of the rail support member 12. The leg assembly 24 includes a stem assembly 28 disposed at the apex of an inverted "V"-shaped leg portion 34 that extends downwardly and outwardly from the apex. While leg portion 34 is shown in this "V" shape, it should be understood that leg portion 34 could have other, alternative shapes such as an "A" shape or other shapes having two leg portions interconnected by bracing. The stem assembly 28 of the shown embodiment is comprised of a first stem 30 and a second stem 32 and are tubular or cylindrical end portions of the overall leg assembly 24. The leg portion 34 itself is made of a first leg 36 and second leg 38 with a brace member 40 attached at points 63, 65. The interconnection is points as shown the distal ends 64, 66 of the first and second legs 36, 38 respectively, thereby forming a triangular-shaped leg assembly 24 as shown in FIG. 1A. Alternatively, the interconnection points 63, 65 of the brace 40 to the first and second legs 36, 38 can be located at a point proximal to the distal leg ends 64, 66, thereby achieving a more "A"-shaped leg assembly (not shown). In such an embodiment, each leg 36, 38 can also be constructed to be adjustable in length to conform to uneven surfaces where one leg needs to be longer than the other. This adjustability can be accomplished with known mechanisms such as telescoping leg segments, for example. Referring also to FIG. 3, an embodiment of the leg socket assembly 22 is shown comprised of a first socket 42 having a first centerline 44, and an adjacent second socket 46 having a second centerline 48. In one embodiment, the first centerline 44 and the second centerline 48 are non parallel and may be positioned so as to converge and intersect at a predetermined point 50 determined by both the angle formed between the centerlines 44, 48 and the distance between the first socket 42 and second socket 46. For example, a socket diameter of substantially one inch results in a preferred distance between the centerlines 44, 48 of the first socket 42 and the second socket 46 of one and one-half inches, measured at the underside surface portion 20 of rail 12. In the embodiment shown in FIG. 3, the predetermined point 50 lies in a vertical plane 62 passing through the longitudinal centerline 14 of rail 12. An alternative embodiment calls for the predetermined point 50 to be located along a line connecting the attachment points 63, 65. In the embodiment of FIG. 3, the distal end of the first leg 64 and the distal end of the second leg 66 are also the attachment points 63, 65.

It should also be understood that while it is believed that optimal operation of the device seems to be achieved when centerlines 44, 48 are non parallel, it is believed that an embodiment where centerlines 44, 48 are substantially parallel to one another is operable and would also provide an acceptable support or hinge device.

Referring back to FIG. 3, the legs assemblies 24, 26 may be manufactured from any of a variety of materials such as aluminum, steel, stainless steel, copper, fiberglass or other circular stock of sufficient diameter and strength to withstand the load and stress suitable for the particular use. For example, the diameter of a metal tubing stock may be 0.5-2.0 inches, and preferably between 0.9-1.1 inches. A typical wall thickness is 0.05-0.3 inches, and preferably between 0.0625 and 0.25 inches. The thicker tube stock produces leg assemblies of superior strength, but with the corresponding tradeoff of greater weight. It should be understood that leg assemblies 24, 26 may be made from various materials with various cross-sectional shapes, such as oval, or polygonal.

The leg assemblies may be manufactured from a single length of tubular metal stock that is bent by a manually operated tube bender or by various automated CNC tube bender systems. Precision leg assemblies can be provided by any one of a number of tube bending services, one of which is Pipelyne Manufacturing (San Jose, Calif.). Alternatively, the leg assemblies can be made from various cut segments of material such as metal tube stock, resulting in a first leg, second leg, brace member and first and second stem portions. These segments could then be constructed into leg assemblies using known methods of assembly such as with friction connectors, threaded connectors, nut and bolts, precision welding, or dip-brazing methods.

The elongated rail support member may be manufactured from a suitable material such as wood, metal, fiberglass, high strength plastic or synthetic materials, high strength composites and combinations thereof, for example. Again, the material should be chosen with the particular use in mind.

Figure 4:
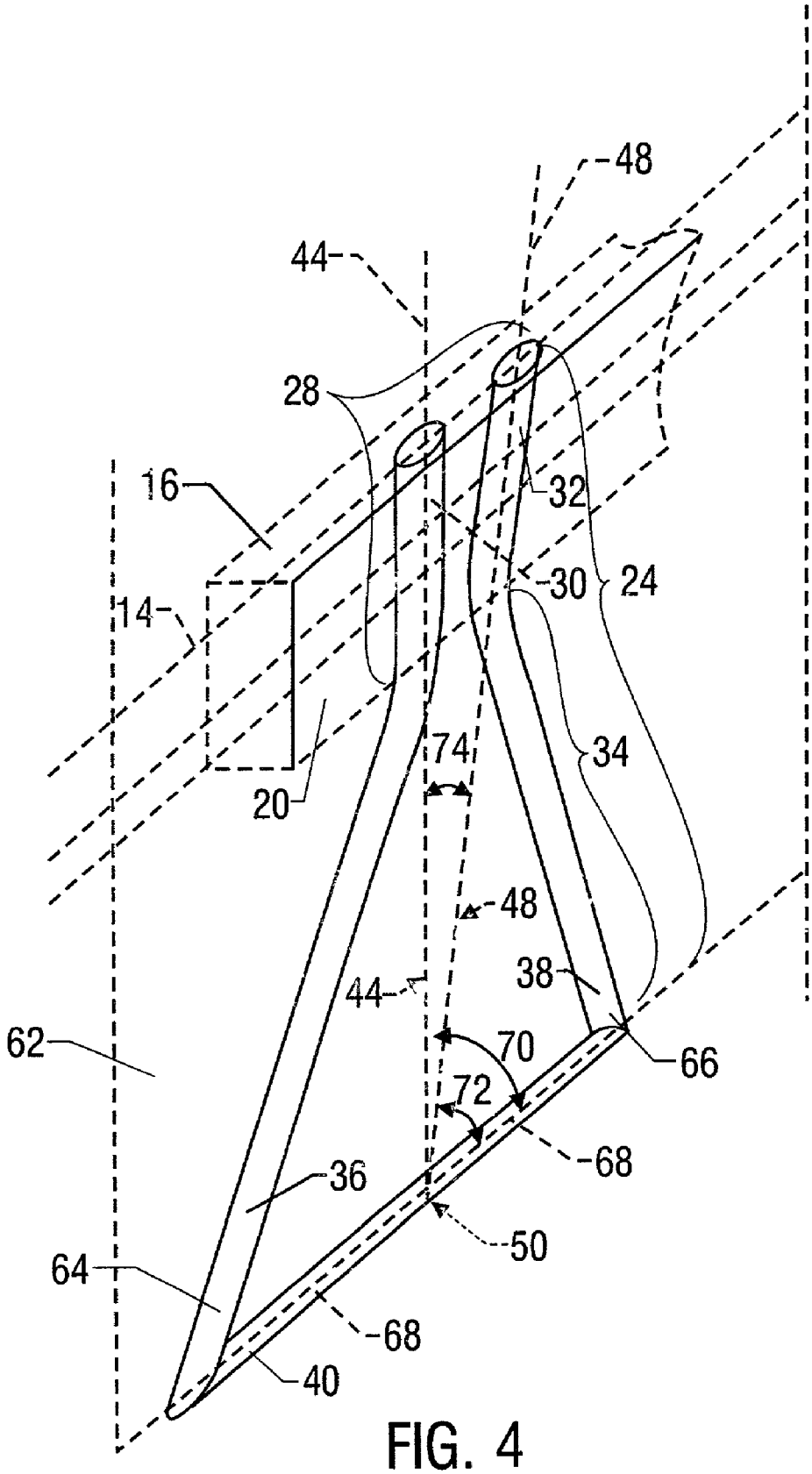
FIG. 4 is a phantom perspective view of the leg socket assembly with the proximal leg assembly inserted into the leg socket at the proximal end of the elongated rail support member depicted in FIG. 3, according to the present invention.

In FIG. 1B and FIG. 4, the leg assembly 24 is shown coplanar with the rail support member 12, as is the first socket 42 and second socket (not shown) of the leg socket assembly 22. This coplanar alignment is illustrated in FIG. 1B by the substantial superimposition of the longitudinal centerline 14 of the rail support member 12, the first centerline 44 of the first socket 42, and the second centerline 48 of the second socket 46 which defines a substantially vertical plane 62 passing through the longitudinal centerline 14 of the rail support member 12. This coplanar alignment produces a substantially flat assembly that is preferred for the storage properties of the invention, such as when the assembly is hung on a wall, or stacked flat on a floor.

Figure 2A:
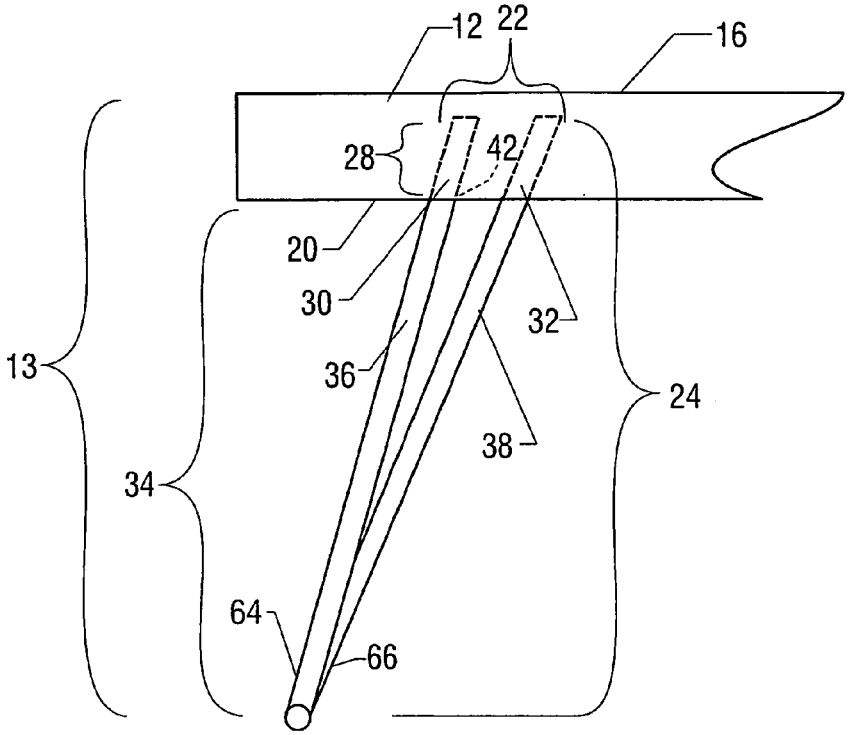
FIG. 2A is a side view illustrating the leg hinge device connected and in a transverse or operational configuration, according to the present invention.
Figure 2B:
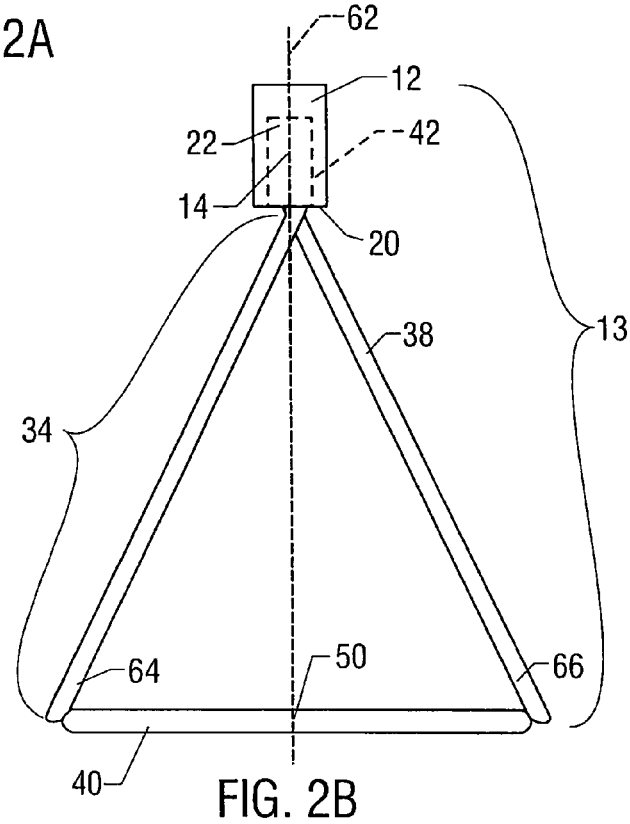
FIG. 2B is an end view illustrating the leg hinge device depicted in FIG. 2A, according to the present invention.

FIGS. 2A and 2B display side and end views of a fully assembled leg hinge device 13. The proximal leg assembly 24 is shown with the stem assembly 28 at least partially inserted into and connected with the leg socket assembly 22. The entire proximal leg assembly 24 has been rotated in a substantially perpendicular direction or substantially ninety degrees from the original coplanar position seen in FIGS. 1A and 1B. In FIGS. 2A and 2B. the leg assembly 24 is now shown substantially transverse in position relative to the rail support member 12. This is a preferred operational configuration of the invention, and provides a stable upright position during active use of the invention. However, under some working conditions, it may be desirable to rotate the leg assembly 24 an alternate amount less than substantially transverse.

As the stem assembly 28 is rotated, the first stem portion 30 and the second stem portion 32 simultaneously rotate in their respective first socket 42 and second socket 46. In the embodiment where the first centerline 44 of the first socket 42 converges and intersects at predetermined point 50 with the second centerline 48 of the second socket 46, the leg assembly 24 will rotate with minimal effort between storage configuration (coplanar) and operational configuration (transverse) without substantial binding occurring between the stem assembly 28 and the leg socket assembly 22. This rotation of the stem assembly 28 tends to reduce the imparting of bending loads to the first stem portion 30 and second stem portion 32, which may cause a misalignment of the entire leg assembly 24.

With reference now to FIG. 3, a phantom illustration of the proximal end portion 16 of the rail support member 12 is shown. It is understood that one embodiment of the present invention includes a distal end portion 18 of rail 12 having a socket assembly and leg assembly substantially identical to that shown in FIG. 3. In FIG. 3, the first socket 42 and second socket 46 are each shown as being comprised of a bore 52 running non parallel and offset relative to each other through the rail support member 12. Each bore 52 is formed with an opening on the underside surface 20 of the rail support member 12. A topside opening from bore 52 as seen in FIG. 3 is optional, and can be closed by having bore 52 extend only partially into rail 12. The non parallel orientation of each bore 52 is illustrated in FIG. 3 by the converging centerlines 44, 48 of each socket 42, 46 or bore 52, which intersect at a predetermined point 50. This intersection point 50 may occur along a line 68 connecting a corresponding intersection point formed by the converging centerlines of the socket assembly at the opposite end of rail 12.

Continuing with FIG. 3, the longitudinal centerline 14 of the rail support member 12 is shown dividing each bore 52 substantially equally and through centerlines 44, 48 of each socket 42, 46. This longitudinal centerline 14 and the line 68 describe a substantially vertical plane 62 that may allow leg assembly 24 to be substantially coplanar and substantially lie flat with the rail support member 12, when in the storage configuration. The predetermined intersection point 50 described above may also lie in the substantially vertical plane 62.

While the socket assembly 22 is shown using a pair of bores 52 formed in rail 16 with stem portions 30, 32 being connected by simply inserting portions 30, 32 into sockets 42, 44, it is believed that stem portions 30, 32 is alternative ways. For example, one could insert one end of a short, intermediate pin member into socket 42 with its second end extending out from socket 42. This second end of the pin member extending from socket 42 could then be inserted into stem portion 30 and allow stem portion 30 to rotate to the desired position. Other ways of rotatably connecting stem portions 30, 32 to socket assembly 22 or directly to rail 16 would be known to a person skilled in the art after having the benefit of this disclosure and its teachings.

Figure 7:
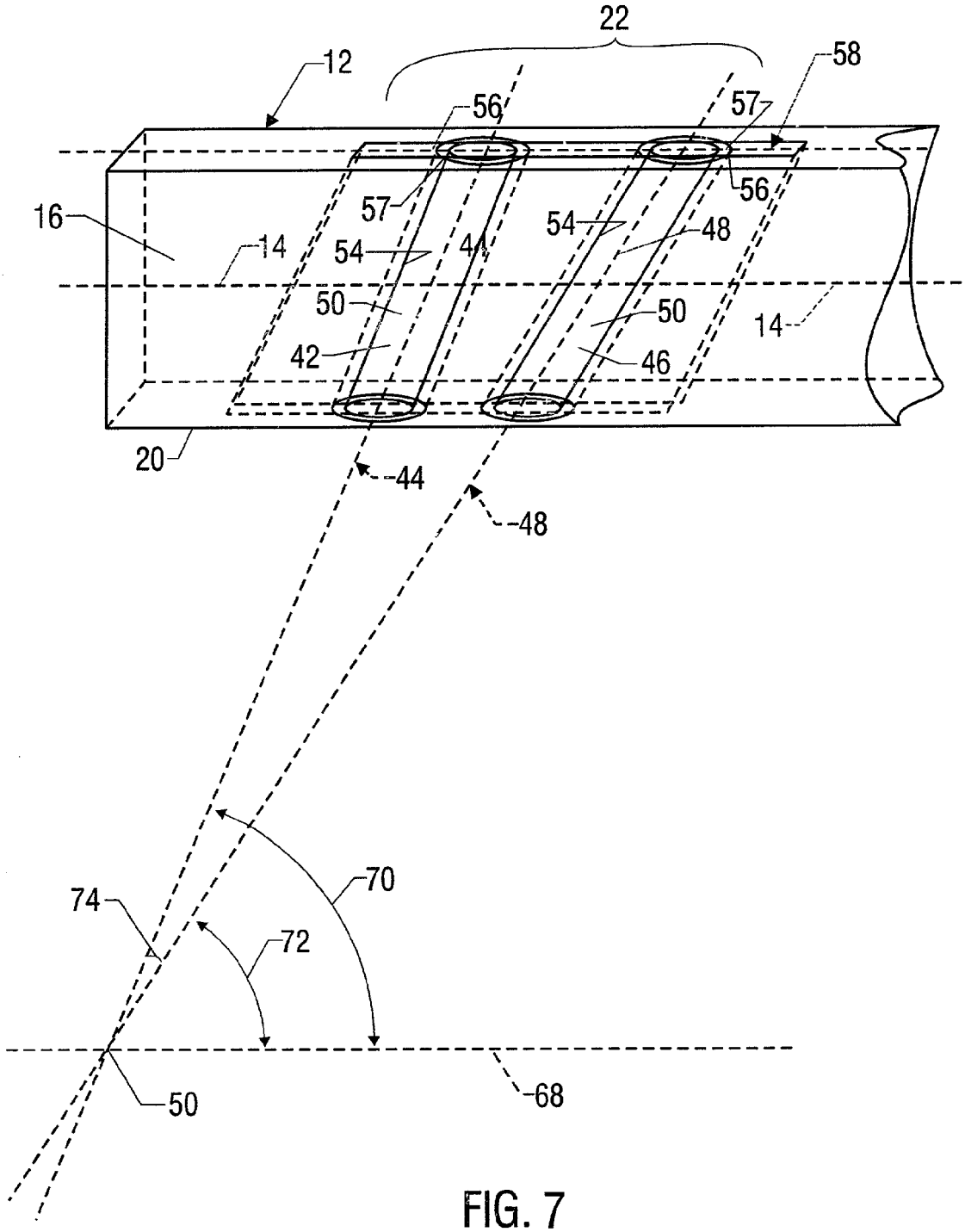
FIG. 7 is a phantom side view of the leg socket assembly at the proximal end of the elongated rail support member, according to the present invention.

With reference now to FIG. 4 and FIG. 7, the phantom illustration of the proximal end portion 16 of the rail support member 12 is displayed with the stem assembly 28 substantially inserted into the rail support member 12 and connected therein. The first centerline 44 is shown intersecting line 68 that connects the distal ends 64, 66 of the first leg 36 and second leg 38 thereby forming acute angle 70 with the horizontal. The second centerline 48 is also shown intersecting line 68 thereby forming acute angle 72 with the horizontal. In one embodiment, the mathematical difference resulting from subtracting acute angle 72 from acute angle 70 is acute angle 74. Angle 74 may be varied somewhat depending on the particular application materials used and size arrangements but it is believed that angle 74 should fall within the range of from two degrees to fifteen degrees. More preferably it is believed that angle 74 should be substantially three degrees. It is recognized that substantially identical acute angles are formed with the longitudinal centerline 14 of the rail support member 12 when rail 16 is substantially horizontal.

Figure 5:
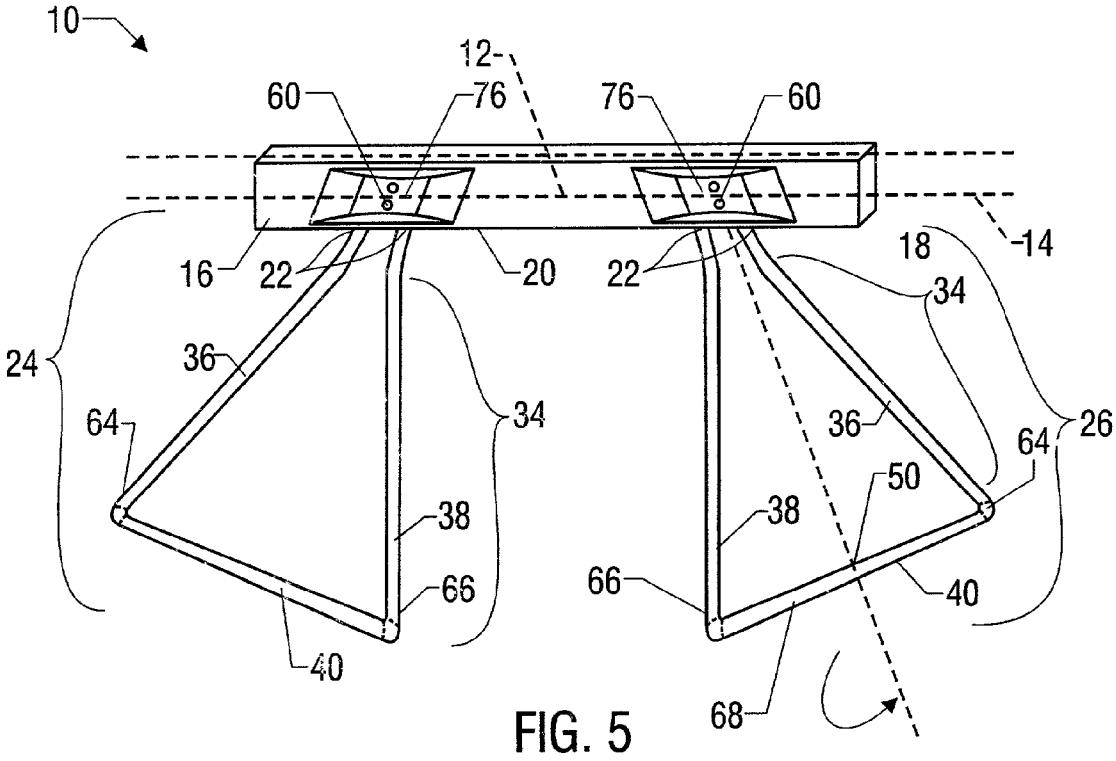
FIG. 5 is a side view of the work piece support assembly in a coplanar storage mode, according to the present invention.

With reference now to FIG. 5, a work piece support assembly 10 apparatus is shown constructed from an elongated rail support member 12 having a proximal end portion 16, a distal end portion 18 and an underside surface portion 20. A proximal leg assembly 24 and a distal leg assembly 26 are inserted into and connected through the leg socket assembly 22 disposed at the proximal and distal end portions 16, 18 of the rail support member 12. The remaining components of leg assemblies 24, 26 were described previously in FIGS. 1A and 1B.

Continuing with FIG. 5, both leg assemblies 24, 26 are illustrated in a substantially coplanar position relative to each other and to the elongated rail support member 12. The leg assemblies 24, 26 are substantially coplanar because line 68 connecting the distal ends 64, 66 of the first and second legs 36, 38 of each leg assembly 24, 26, when combined with the longitudinal centerline 14 of the rail support member 12, define a substantially vertical plane 62 (not shown). This vertical plane is preferred for an apparatus such as this work piece support assembly 10 to lie flat so that it may be either hung on a wall or stacked serially. This storage configuration occupies less space than the operational configuration because of the flattening effect that occurs when both leg assemblies 24, 26 are rotated substantially transverse to a coplanar position under the rail support member 12.

The elongated rail support member 12 displayed in FIG. 5 also includes thickened reinforced portions 76 of the rail support member 12. These reinforced portions 76 may be attached to or integral with the sides of the rail support member 12. The reinforced portions serve to improve lateral strength of the rail support member 12 in the regions where an adjustable clamping member 60 may be used to tighten or secure the leg socket assemblies 22 around the stem assembly 28 of the leg assemblies 24, 26. In FIG. 5, the adjustable clamping member 60 is illustrated as two bolts passing through a transverse bore to the opposing side of the rail support member 12. The two bolts are threaded on the ends and are secured with a standard nut, a threaded "T"-nut or a wing-nut that can be finger tightened. Alternatively, the transverse bore on the opposing side of the rail support member 12 is internally threaded so as to engage and tighten against the threads of the engaging bolt. Other alternatives may use a bolt that could be engaged and tightened using either friction fit clasps, tightening devices or other mechanical means known to clamp down on bolts, and that are well known to those skilled in the art.

Figure 6:
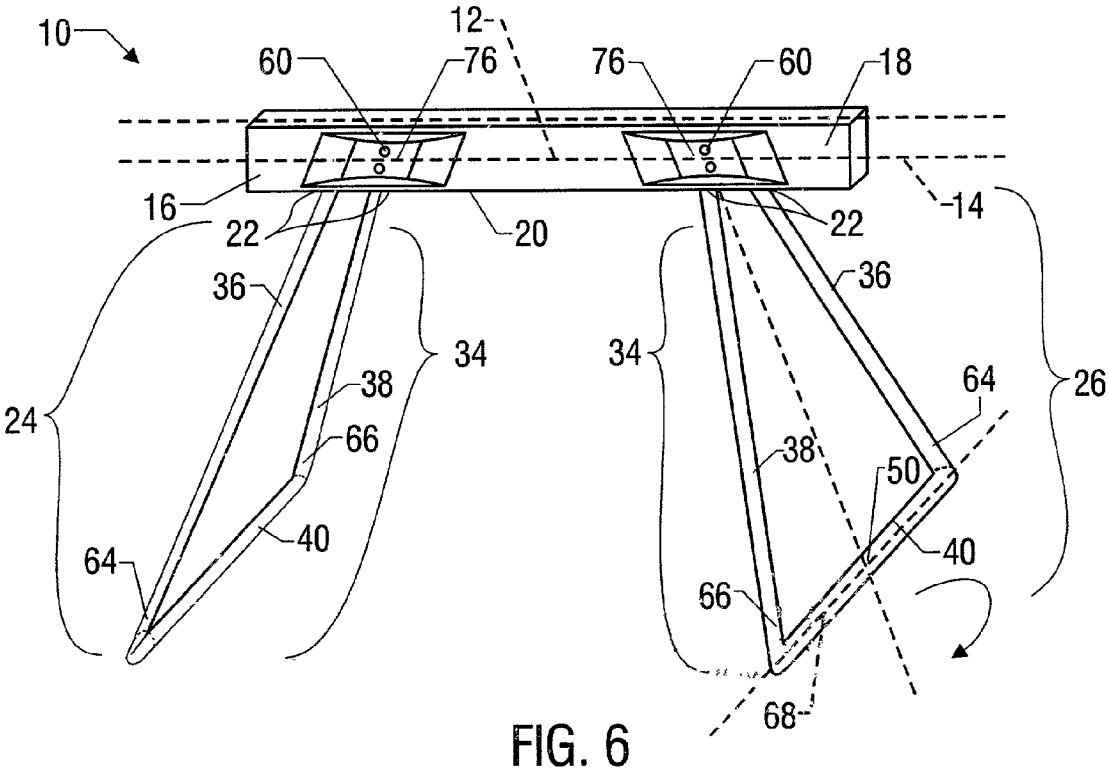
FIG. 6 is a side view of the work piece support assembly depicted in FIG. 5, in a transverse operational mode, according to the present invention.

The embodiment shown in FIG. 6 discloses the use of adjustable clamping member 60 having two bolts used to "squeeze" internal slot 58 (see FIG. 8) to retain stem portions 30, 32 in the desired position. However, it should be understood that socket assembly 22 may use alternative adjustable catch mechanisms for retaining stem portions 30, 32 in a selected position. For example, where centerlines 44, 48 are non parallel and converging, a movable wedge mechanism (not shown) could be mounted between stem portions 30, 32 within rail 16 (bores 52 being replaced by a single slot with internal end walls tapering parallel to centerlines 44, 48). Other catch mechanisms are also available such as spring biased pins within stems 30, 32 which spring outwardly into holes or keyed slots within sockets 42,46 (not shown). Other catch mechanisms which allow stems 30, 32 to be rotated within sockets 42, 46 to a selected position and then releasably retained in that position would be known to a person skilled in the art with the benefit of this disclosure and teachings.

With reference now to FIG. 6, a work piece support assembly 10 with components corresponding to that shown in FIG. 5 is illustrated. Here, both leg assemblies 24, 26 have been rotated placing the leg portion 34 substantially transverse to the rail 12 so that the leg assemblies 24, 26 are now substantially perpendicular or substantially ninety degrees relative to the elongated rail support member 12. This was previously disclosed above in greater detail for FIGS. 2A and 2B. Here, FIG. 6 displays the operational configuration of one embodiment of the work piece support assembly 10, in a configuration designed to provide a stable platform for work pieces. Stability of the work piece support assembly 10 can be adjusted for uneven floor or earthen surfaces by adjusting the extent stems 30, 32 are inserted into sockets 42, 46 or by slight over or under rotation of the leg assemblies 24, 26 which has the effect of lengthening or shortening individual legs 36, 38 resulting in substantially no rocking of the assembly. The distal ends 64, 66 of the first leg 36 and the second leg 38 of both leg assemblies 24, 26 that are in direct contact with the floor, can be surrounded by a non-skid rubber, plastic or synthetic elbow sleeve (not shown) so as to minimize skidding or slippage of the apparatus.

With reference now to FIG. 7, a phantom illustration of longitudinal relief slot 58 formed in the proximal end portion 16 of a rail support member 12 is shown. A substantially identical relief slot may exist at the distal end portion of this rail support member 12. The relief slot 58 is substantially disposed along the longitudinal centerline 14 of the elongated rail support member 12 between the underside surface 20 and the topside surface of the rail 12. The relief slot 58 is designed to provide strain relief to the leg socket assembly 22 and lateral flexure suitable for tightly securing a leg assembly 24 with the leg socket assembly 22 when one embodiment of an adjustable catch member is applied.

Figure 8:
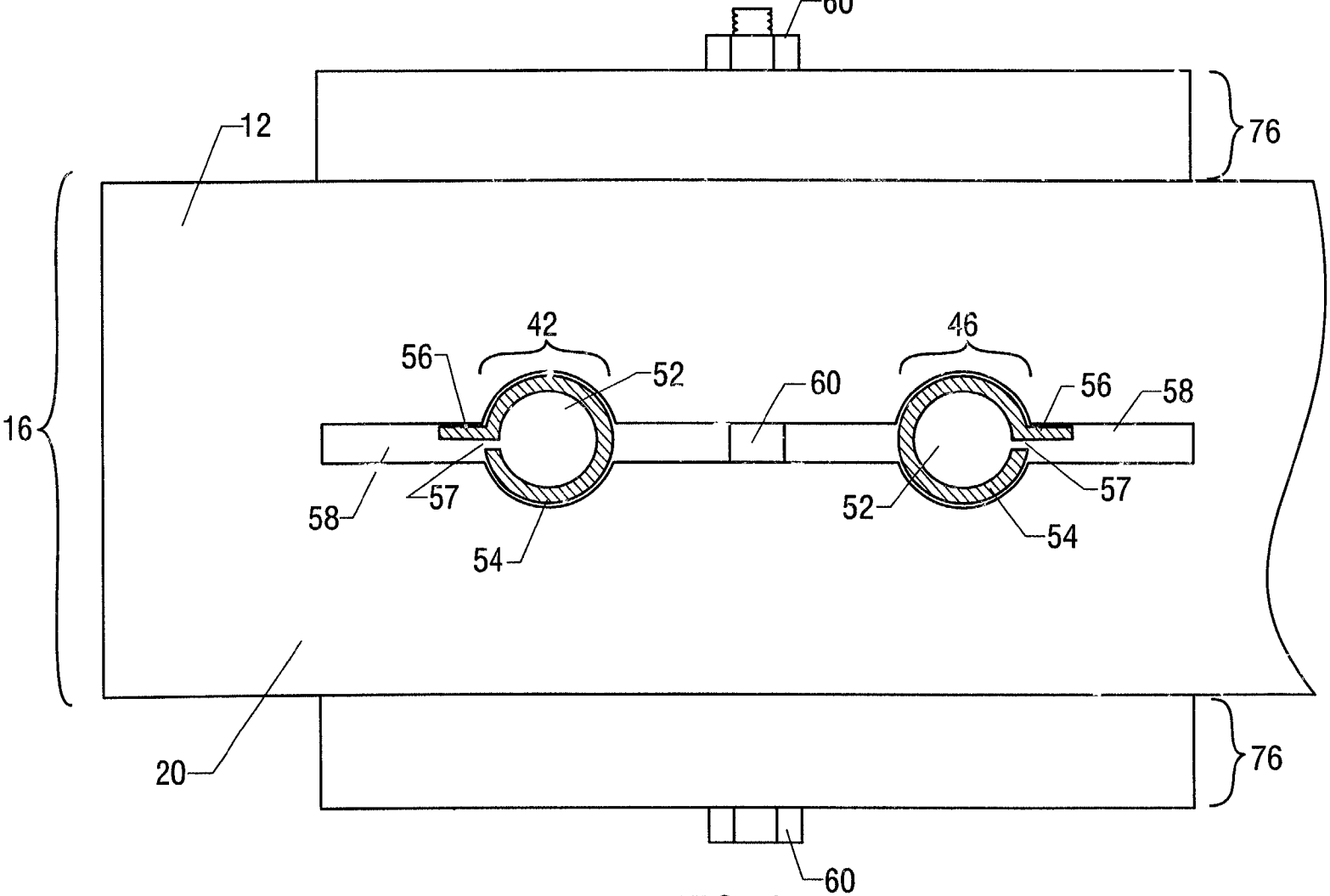
FIG. 8 is a bottom view of a portion of the proximal end of the elongated support member and leg socket assembly, illustrating the longitudinal relief slot, bushing member and tab, according to the present invention.

Also shown in FIG. 7 and FIG. 8 is a bushing member 54 inserted into the bore 52 of the first socket 42 and second socket 46. The bushing 54 may be tubular in shape, slightly smaller in diameter than the bore 52 itself, and include a longitudinal gap or slot 57 juxtaposed to a longitudinal tab 56. Each bushing 54 is designed to be compressed and secured around the stem assembly inserted into the leg socket assembly 22, when the adjustable clamping member is applied and tightened.

In addition, FIG. 7 illustrates a side view of the first and second acute angles 70, 72 that are produced by the respective first and second centerlines 44, 48 from the first and second sockets 42, 46 as they intersect at predetermined point 50. These acute angles were previously disclosed in greater detail in the discussion for FIG. 4 above.

With reference now to FIG. 8, a bottom view illustrates the underside surface 20 of the proximal end portion 16 of the elongated rail support member 12. In this embodiment, the longitudinal relief slot 58 is shown formed through the first socket 42 and second socket 46. A bushing member 54 is shown inserted into each bore 52. Each bushing 54 has a longitudinal slot 57 that allows the bushing 54 to be compressed around the stem portion of a leg assembly. The bushing 54 also has a longitudinal tab 56 that protrudes into the relief slot 58, thereby preventing the bushing 54 from rotating between the bore 52 or socket, and the stem portion 30 during use. FIG. 8 also displays a bottom view of the reinforced portions 76 of the rail 12, and one embodiment of the adjustable clamping member 60, shown here as a nut and bolt assembly.

A kit that contains all the components disclosed above and that are readily assembled into a work piece support assembly is disclosed and described herein. The components would be contained in a kit box, or in some other packaging that localizes the parts in one place. This kit contains the elongated rail support member described above as including a longitudinal centerline, opposing end portions each adapted for having a leg socket assembly, and an underside surface portion with openings for the bore holes. The kit also includes a pair of identical leg assemblies each adapted for insertion and connection into a respective leg socket assembly, where each leg assembly has a stem assembly defined as a pair of stem portions machined and formed for connection to the socket assembly. Each stem assembly has a connected leg portion defined as two downward and outward legs interconnected by a brace member. Each leg socket assembly in the kit is substantially identical and has two adjacent sockets. The stem assembly is specific for insertion into either leg socket assembly, thereby allowing each leg portion to be rotated between either a substantially coplanar or substantially transverse position relative to the elongated rail support member, as previously described.

This invention also provides a method for constructing a support assembly comprised of steps that result in a hinge pivoting a leg assembly, where the hinge is connected to a work piece support assembly. The first step provides an elongated rail support member having a longitudinal centerline, opposing proximal and distal end portions each having an identical leg socket assembly, and an underside surface portion having adjacent open bore holes. Two identical leg assemblies are adapted for connection to either identical leg socket assemblies used to support the elongated rail support member. Each leg assembly is formed to have a stem assembly that has two adjacent stem portions, and a leg portion. Both stem assemblies are connected to a respective leg socket assembly. Each socket assembly is formed with a first and second socket with first and second centerlines that may be non parallel relative to each other so that both socket centerlines converge to a predetermined point of intersection. Each leg portion or leg assembly is rotated from a substantially coplanar position to a substantially transverse position, relative to the rail support member and clamped in position.

Thus, while the preferred and alternative embodiments of the hinge device, work piece support assembly apparatus and kit, and method for pivoting a leg hinge of the present invention have been described and referenced to the environment in which they are developed, they are merely illustrative of the principles of the inventions. It will be apparent to one skilled in the art that various changes and modifications may be made and equivalents employed, without departing from the present invention, such as varying the specific shape of the leg portions, alternative bracing arrangements for the leg portions, the socket assembly details or the magnitudes of the intersecting angles.

What is claimed is:

1. A rotatable leg hinge comprising:

a member having a horizontal centerline;

a leg socket assembly formed in the member, the leg socket assembly comprising a first socket having a first socket centerline and a second socket having a second socket centerline, the first socket centerline and second socket centerline being non-parallel and intersecting at a predetermined point below the member wherein the predetermined point lies in a vertical plane defined by the horizontal centerline of the member, the first socket centerline, and the second socket centerline;

a leg assembly extending below the member comprising a first leg, a second leg, and a brace, the brace being connected between leg first leg and the second leg, the first leg having a first stein portion connected to a first lower leg portion, the first stem portion and first lower leg portion being nonlinear wherein the first stem portion is rotatably connected to the first socket and the second leg having a second stem portion and a second lower leg portion, the second stem portion and second lower leg portion being nonlinear wherein the second stem portion is rotatably connected to the second socket; and wherein the leg assembly may be rotated from a first position wherein the brace is substantially coplanar with the vertical plane to a second position wherein the brace is substantially perpendicular to the vertical plane.

2. The rotatable leg hinge of claim 1, wherein the first socket includes a bushing member adapted for receiving the first stem portion.

3. The rotatable leg hinge of claim 2, wherein the second socket includes a bushing member adapted for receiving the second stem portion.

4. The rotatable leg hinge of claim 1, wherein the first socket includes an adjustable catch for retaining the first stem portion.

5. The rotatable leg hinge of claim 4, wherein the second socket includes an adjustable catch for retaining the second stem portion.

6. The rotatable leg hinge of claim 4, wherein the adjustable catch includes a longitudinal relief slot formed in at least a portion of the first socket and the hinge member.

7. The rotatable leg binge of claim 1, wherein the predetermined point of intersection of the first socket centerline and the second socket centerline is on the brace connected between the first leg and the second leg.

8. The rotatable leg hinge of claim 1, wherein the first socket centerline forms a first acute angle with the horizontal centerline of the member.

9. The rotatable leg hinge of claim 8, wherein the second socket centerline forms a second acute angle wit the horizontal centerline of the member.

10. The rotatable leg hinge of claim 9, wherein the second acute angle is greater than the first acute angle by an amount falling within the range of two to fifteen degrees.

11. The rotatable leg hinge of claim 1, wherein the predetermined point of intersection of the first socket centerline and the second socket centerline lies along a line connecting the point of the attachment of the brace member to the first leg and the point of attachment of the brace member to the second leg.

12. The rotatable leg hinge of claim 1, wherein the predetermined point of intersection of the first socket centerline and the second socket centerline lies along a line between a distal end of the first leg and a distal end of the second leg.

* * * * *

UNITED STATES PATENT AND TRADEMARK OFFICE

CERTIFICATE OF CORRECTION

PATENT NO. : 7,311,178 B2
APPLICATION NO. : 09/949944
DATED : December 25, 2007
INVENTOR(S) : James P. Blackwell It is certified that error appears in the above-identified patent and that said Letters Patent is hereby corrected as shown below:

In Claim 1, col. 9, line 45, after “between” delete “leg” and insert --the--;

In Claim 6, col. 10, line 24, delete “hinge”;

In Claim 7, col. 10, line 25, delete “binge” and insert --hinge--; and

In Claim 9, col. 10, line 33, delete “wit” and insert --with--.

Signed and Sealed this

Twenty-ninth Day of April, 2008

JON W. DUDAS
*Director of the United States Patent and Trademark Office*